US007000652B1

(12) United States Patent
Moulton

(10) Patent No.: US 7,000,652 B1
(45) Date of Patent: Feb. 21, 2006

(54) APPARATUS AND METHOD FOR THE PRESSURE TESTING OF FUEL DELIVERY VAPOR RECOVERY SYSTEMS

(76) Inventor: Herbert W. Moulton, 102 Moran Way, Santa Cruz, CA (US) 95062

( * ) Notice: Subject to any disclaimer, the term of this patent is extended or adjusted under 35 U.S.C. 154(b) by 0 days.

(21) Appl. No.: 11/015,464

(22) Filed: Dec. 16, 2004

(51) Int. Cl.
*B65B 1/04* (2006.01)

(52) U.S. Cl. ..... 141/83; 141/59; 73/37
(58) Field of Classification Search ..... 141/59, 141/83, 392, 206–216, 98, 94, 95; 73/37, 73/40, 40.5 R, 49.1
See application file for complete search history.

(56) References Cited

U.S. PATENT DOCUMENTS

| | | | | |
|---|---|---|---|---|
| 5,201,213 | A * | 4/1993 | Henning | 73/49.2 |
| 5,220,822 | A * | 6/1993 | Tuma | 73/40.5 R |
| 5,284,480 | A * | 2/1994 | Porter et al. | 604/97.03 |
| 6,038,929 | A * | 3/2000 | Smith | 73/756 |
| 6,763,701 | B1 * | 7/2004 | Moretz | 73/37 |

OTHER PUBLICATIONS

California EPA Vapor Recovery Test Procedure, as Amended Mar. 17, 1999.

* cited by examiner

*Primary Examiner*—Steven O. Douglas
(74) *Attorney, Agent, or Firm*—Michael A. Guth

(57) ABSTRACT

A method and apparatus for testing of a portion of a fueling and fuel vapor recovery system. The apparatus is adapted to pressure test a fuel delivery hoses, break-away, and nozzle combination. The fueling and fuel vapor recovery system can be tested in parts in order to determine whether a particular portion has failed.

12 Claims, 9 Drawing Sheets

APPARATUS AND METHOD FOR THE PRESSURE TESTING OF FUEL DELIVERY VAPOR RECOVERY SYSTEMS

BACKGROUND

1. Field of the Invention

The present invention relates to fuel delivery and vapor recovery systems, and more specifically to an apparatus and method for the pressure testing of fuel delivery systems with vapor recovery.

2. Description of Related Art

Gasoline dispensing facilities, such as service stations, often suffer from a loss of fuel to the atmosphere due to inadequate vapor collection during fuel dispensing activities. Lost vapor is an air pollution problem which is monitored and regulated both by the federal and state governments. Attempts to minimize losses to the atmosphere have been affected by various vapor recovery methods. One such method is "Stage-II vapor recovery" where vapors are returned from the refueled vehicle tank to the underground storage tank.

When working properly, Stage-II vapor recovery results in equal exchanges of air of vapor and liquid between the main fuel storage tanks and the consumer's gas tank. Ideally, returned vapor replaces an equal amount of liquid in the main fuel storage tank during refueling transactions. A variety of vapor recovery nozzles exist today. Typically, a vapor recovery nozzle works with a vapor recovery fuel dispensing line to return vapors from the vehicle tank being fueled while simultaneously delivering fuel from the main storage tank to the vehicle fuel tank. There are at least two types of vapor recovery systems in use today. A vapor assist system typically utilizes vacuum to return the vapors from the vehicle tank being fueled to the main storage tank. A balance system typically utilizes the ingoing fuel to displace the air/vapor in the tank being fueled and return the air/vapor to the main storage tank.

A problem that exists is that occasionally customer at a service station forgets to remove the fuel delivery nozzle from the vehicle prior to driving away. Most fuel dispensers are equipped with a breakaway device in the fuel delivery line system so that the dispenser is not damaged. The breakaway portions, typically the fuel dispenser's external fuel hose and the fuel delivery nozzle, can be reattached to the fuel dispenser. However, if the nozzle, fuel hose, or breakaway device has been damaged, the relatively airtight vapor recovery system may not function properly. Many regions' regulations require that the fuel dispenser's hoses and breakaway device be replaced or tested after the components have been broken away.

What is called for is an efficient and portable handheld apparatus and method to pressure test the pump's external system to confirm that the vapor recovery system portion which includes the nozzle and fueling line is operational.

SUMMARY

A method and apparatus for testing of a portion of a fueling and fuel vapor recovery system. The apparatus is adapted to pressure test a fuel delivery line and nozzle. The fueling and fuel vapor recovery system can be tested in parts in order to determine whether a particular portion has failed.

DETAILED DESCRIPTION

Figure 1:
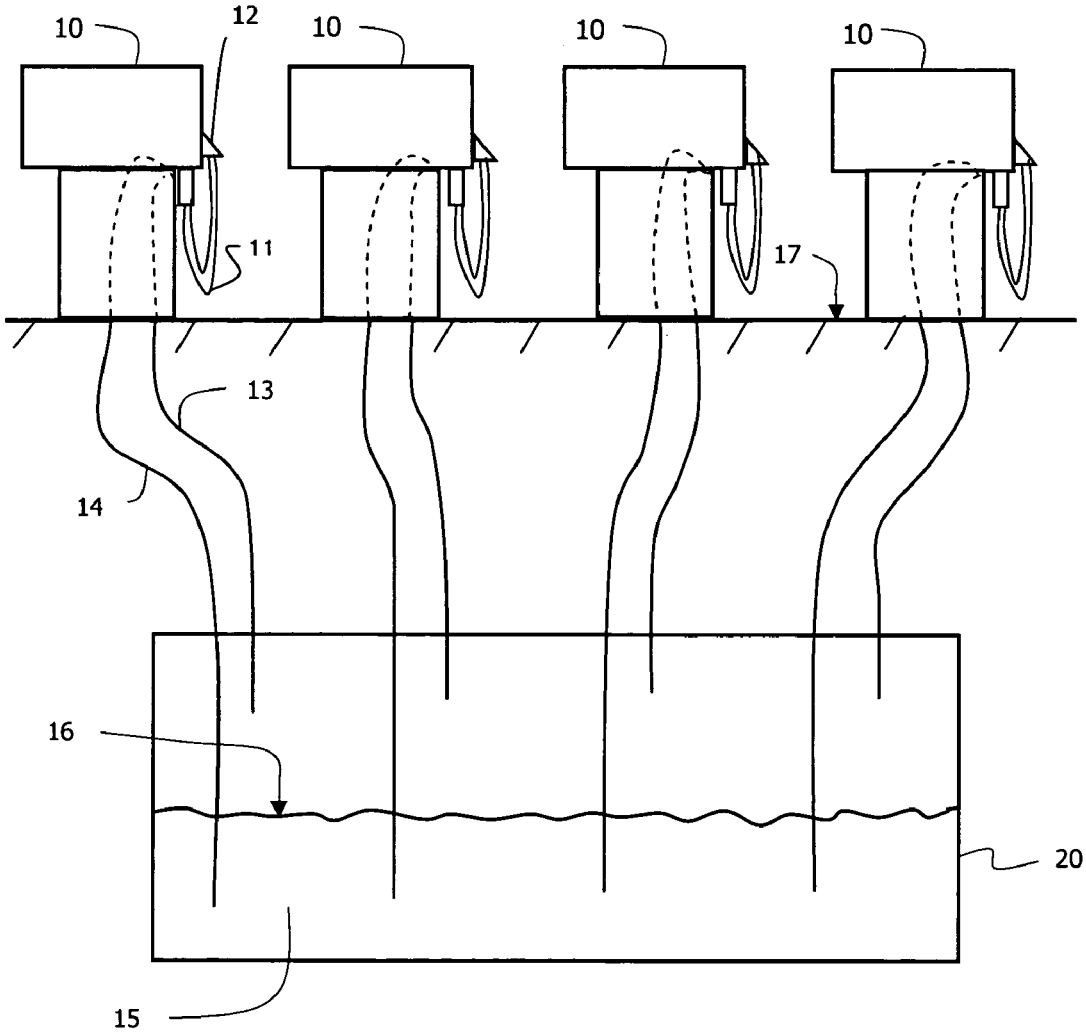
FIG. 1 is a pictorial representation of filling station dispensers and their underground storage tank.

FIG. 1 is a simplified pictorial representation of a typical filling station fueling system utilizing a vapor recovery system. A plurality of fuel dispensing dispensers 10 reside above the ground 11. Each dispenser has a nozzle and a fuel dispensing hose 11. Under the ground 17 there is a fuel storage tank 20 which contains fuel 15 up to a level 16.

In a typical vapor recovery system, the nozzle 12 and the fuel dispensing hose 11 are adapted to route fuel vapors back to the tank 20 while dispensing fuel into a vehicle. The fuel is routed from the tank 20 through a fuel delivery hose 14, through the fuel dispenser 10, and on to the vehicle through the fuel dispensing hose 11 and the nozzle 12. The nozzle 12 is adapted to capture the fuel vapors that emanate from the vehicle's fuel tank as the tank is filled. The fuel dispensing hose 11 is typically a double hose, where a central line delivers the fuel, and a surrounding hose forming an annulus around the central line return the vapor. The vapor is returned to the fuel tank 20 via a vapor return line 13.

Figure 2:
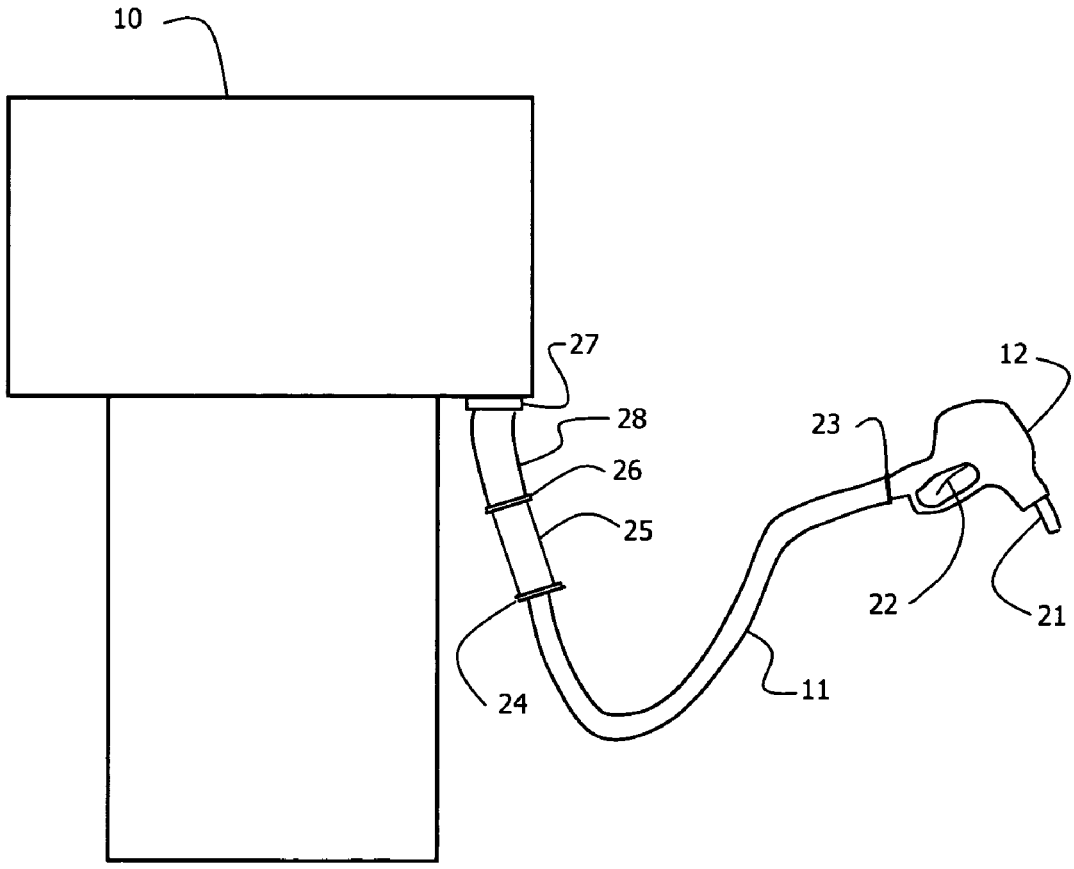
FIG. 2 is a pictorial representation of a filling station dispenser and its hoses and nozzle.

FIG. 2 is a simplified pictorial representation of a typical filling station dispenser 10 as adapted for both vapor recovery and to withstand dramatic pulling on the nozzle, such as when a driver drives off with the nozzle still in the vehicle's fuel tank. In order to withstand such a circumstance without severe and possibly catastrophic damage, a typical fuel dispenser 10 incorporates a break-away device 25 in line between a short dispensing hose 28 and a long dispensing hose 11. In other examples, the break-away device may be inline in the fuel hose in other ways. The purpose of the break-away device 25 is to come apart under a load, so that the dispenser is not subjected to high forces. The break-away device 25 can typically be reassembled and re-used.

In a typical example, the short dispensing hose 28 is attached to the fuel dispenser 10 at a coupling 27. Another coupling 26 links the short dispensing hose 28 to the break-away device 25. The break-away device 25 is linked to the long dispensing hose 11 at a coupling 24. The long dispensing hose 11 is linked to the nozzle 12 at a coupling 23. The nozzle has a spout 21 and a trigger 22.

With a vapor recovery system, the integrity of the system is based in part on the fluidic seal of the vapor recovery components. Without adequate sealing, the vapor may be lost to the atmosphere, and not be returned to the tank. In addition, if the vapor recovery system is under vacuum, a loss of integrity of the fluidic seal in the system may prevent the entire multi-pump system's vapor recovery portion from functioning properly. For this reason, most jurisdictions have requirements imposed upon the fueling and vapor recovery system. Typically, the entire system, including all pumps, lines, and the underground tank must be tested to ensure that the integrity of the system meets standards.

After a break-away device has been broken away, the nozzle, fuel dispensing hoses, and break-away device may be reassembled and reused. It may be necessary to test the nozzle, fuel dispensing hoses, and break-away device prior to reattachment to the dispenser to ensure the integrity of the components. This ensures that damaged components are not reassembled into the larger system.

Figure 3:
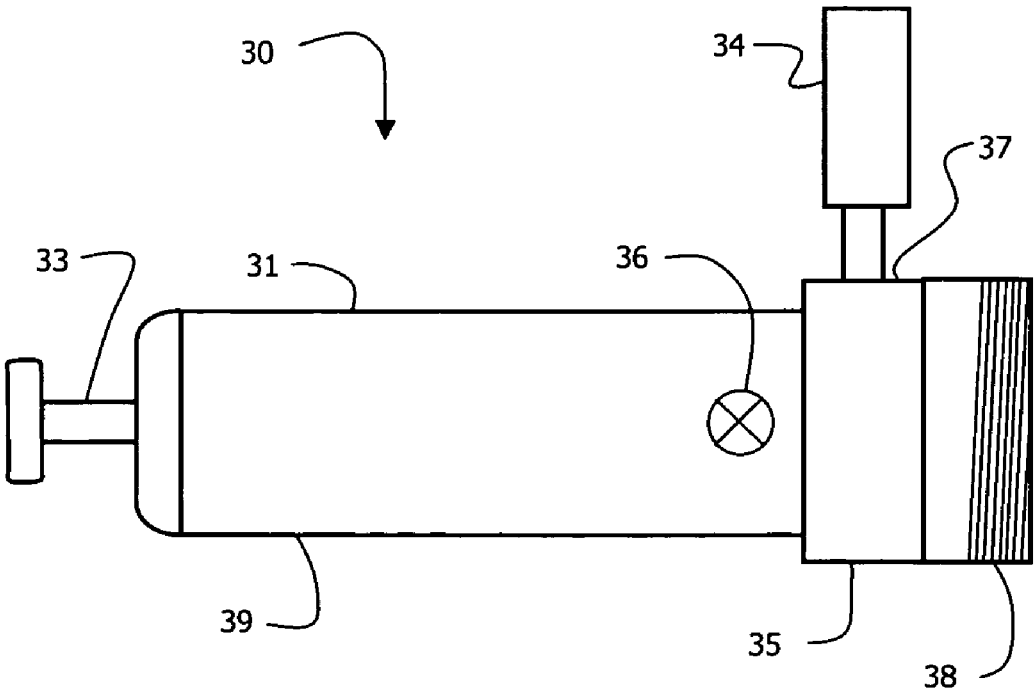
FIG. 3 is a pictorial representation of a fuel hose pressure testing pump according to one embodiment of the present invention.

In some embodiments of the present invention, as seen in FIG. 3, an apparatus 30 is adapted to pressure test a fuel hose and vapor recovery system. A pump body 31 is adapted to provide pressure by the pumping of the handle which is attached to the end of a pump shaft 33. A pump coupler 35 is attached to the pump body 31 downstream from the internal pump check valve. A pressure relief valve 36 is attached to the pump body 31 upstream from the internal pump check valve in some embodiments. In some embodiments, the apparatus 30 has a pressure gauge 34 for measuring pressure. A pump extension 37 extends out from the pump coupler 35 in some embodiments. A fuel system coupler 38 is used to attach the test pump 39 to a fueling and vapor recovery system, or portion thereof, to be tested.

In some embodiments, the pressure gauge may include a test verification portion. In some embodiments, the test verification portion is adapted to measure and record the pressure over a period of time. In some embodiments, the pressure gauge may include a marking pen or similar device to record the pressure on a paper that rotates with time. In some embodiments, the pressure gauge may include a timing device. In some embodiments, the timing device may be attached to another portion of the test pump. In some embodiments, the test verification portion may be an electronic system adapted to verify a minimum pressure over a period of time. In some embodiments, this electronic system may include a pressure sensor, a read-out, and a memory portion.

The test pump 39 is adapted for the pressure testing of a fueling and vapor recovery system. In some embodiments, the fuel system coupler 38 is attached to a break-away portion of a fueling hose in order to pressure test the break-away device, the fuel dispensing hoses, and the nozzle. After attachment to the short dispensing hose, the test pump 39 is hand pumped by the use of the handle. The pressure gauge 34 is utilized both to read the pressure delivered during pumping, and also allows for the monitoring of the portions under test in order to verify the integrity of the system. In a vapor recovery system, the system should hold the pressure delivered. The pressure relief valve 36 relieves pressure if the system is subjected to too much pressure. The pressure relief valve 36 prevents damage that may occur if the system is over pressurized, such as damage to the pressure gauge. In some embodiments, the pressure relief valve may be integral to the pressure gauge or another portion of the apparatus. The test pump components will be made of fuel resistant materials in some embodiments.

Figure 4:
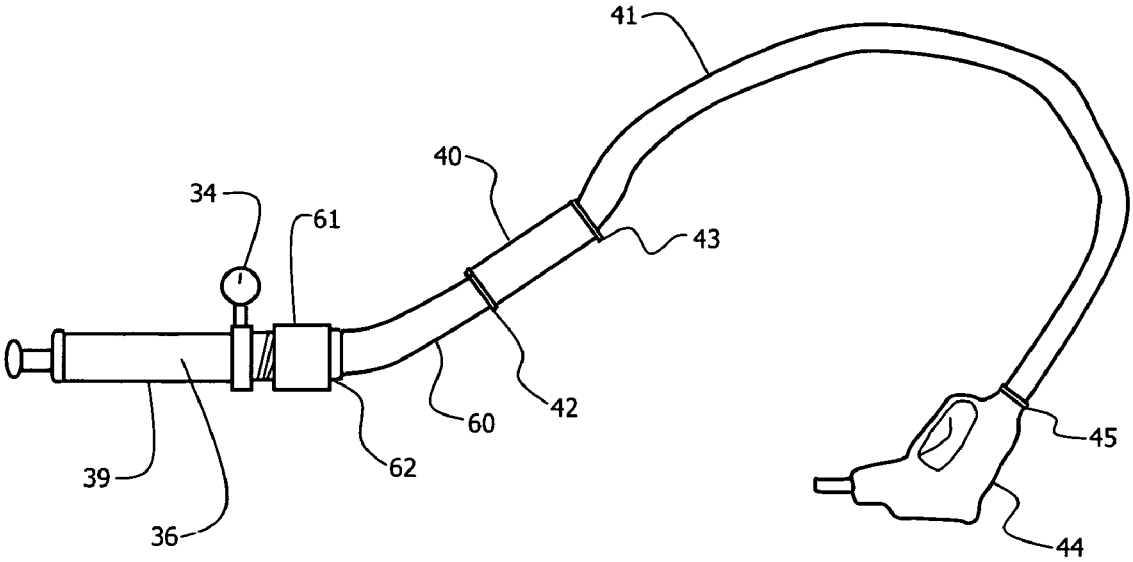
FIG. 4 is a pictorial representation of a break-away device, fuel hoses and nozzle being tested according to one embodiment of the present invention.

FIG. 4 illustrates the apparatus in use during the testing of a break-away device, fuel dispensing hoses, and nozzle. The test pump 39 has been fastened to the short dispensing hose 60. Typically, the short dispensing hose 60 has a first male coupler 62 and the coupling of the short dispensing hose 60 to the test pump 39 utilizes a double female coupler 61. In some embodiments, the couplers utilize a threaded fitting and an o-ring seal. The short dispensing hose 60 is coupled to the break-away device 40 at a first coupling 42. The break-away device 40 has a second coupler 43 for attachment of the break-away device 40 to the long fuel dispensing hose 41. The long fuel dispensing hose is attached to the nozzle 44 with a coupling 45. Typically, all of the couplings along the fueling system utilize threaded coupling and o-rings.

The test pump 39 is hand pumped to pressurize the components attached. The pressure gauge 34 reads out the pressure in the system and is readily observable by the user. The pressure relief valve 36 prevents damage to the pressure gauge 34 or other components due to inadvertent over-pressurization. The pressure gauge may read out pressure in units of inches of water or psi in some embodiments. Once the components have been pressurized, the pressure gauge 34 can be monitored by the user to verify the integrity of the components under test. For example, if the components are pressurized to 2 inches of water, the pressure gauge may be monitored to verify that the pressure does not drop over a certain period of time, such as two minutes. In many regions of the country, regulations specify a pressure that components must be tested to, and the duration of time that the pressure must be maintained. Although the break-away device, fuel dispensing hoses, and nozzle may all be tested together, individual components may be tested with the use of various plugs and adapters, as discussed below. Should the break-away device, fuel dispensing hoses, and nozzle, when tested together, show the needed integrity, the testing of individual portions may not be necessary. However, if the group of components does not hold the pressure desired by the user, and the user wishes to narrow down the source of the leak, the group of components may be disassembled and tested individually so that the source of the leak may be ascertained.

Figure 5:
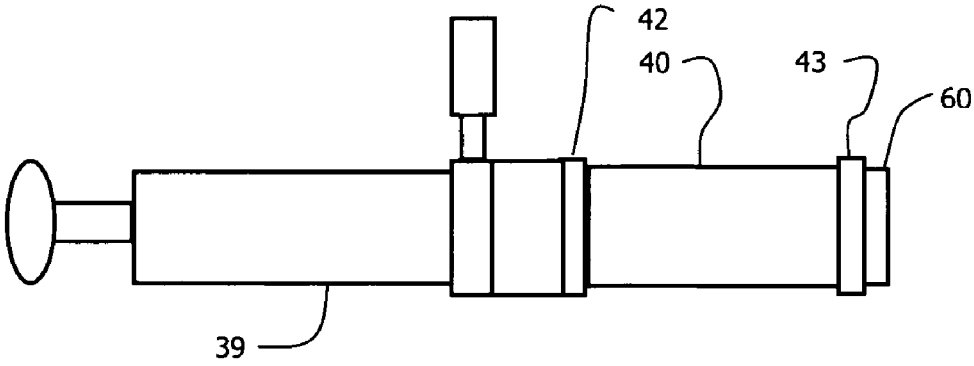
FIG. 5 is a pictorial representation of a break-away device being tested according to one embodiment of the present invention.
Figure 6:
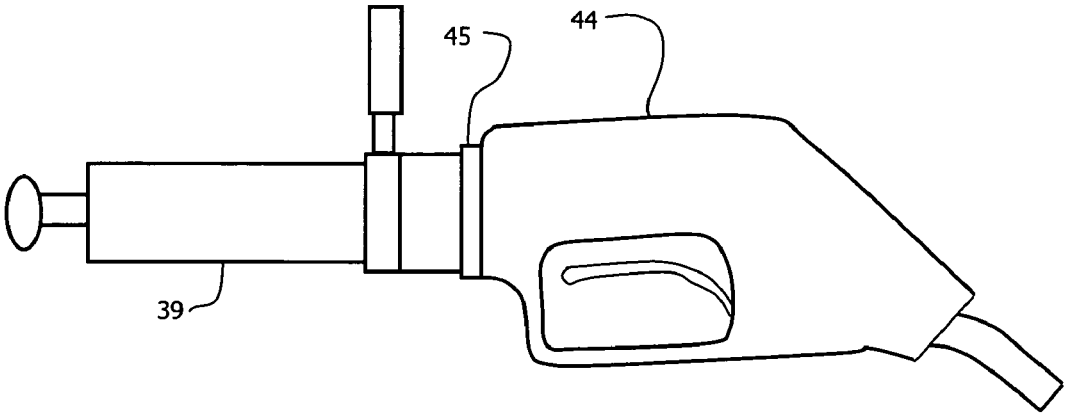
FIG. 6 is a pictorial representation of a fuel dispensing nozzle being tested according to one embodiment of the present invention.

FIG. 5 illustrates the apparatus in use during the testing of a break-away device. The test pump 39 has been fastened to the break-away device 40 at the first coupler 42. An airtight plug 60 has been attached to the second female coupler 43. In some embodiments, the break-away device has female threaded couplings at both ends. In some embodiments, the plug 60 is a male threaded plug.

Figure 7:
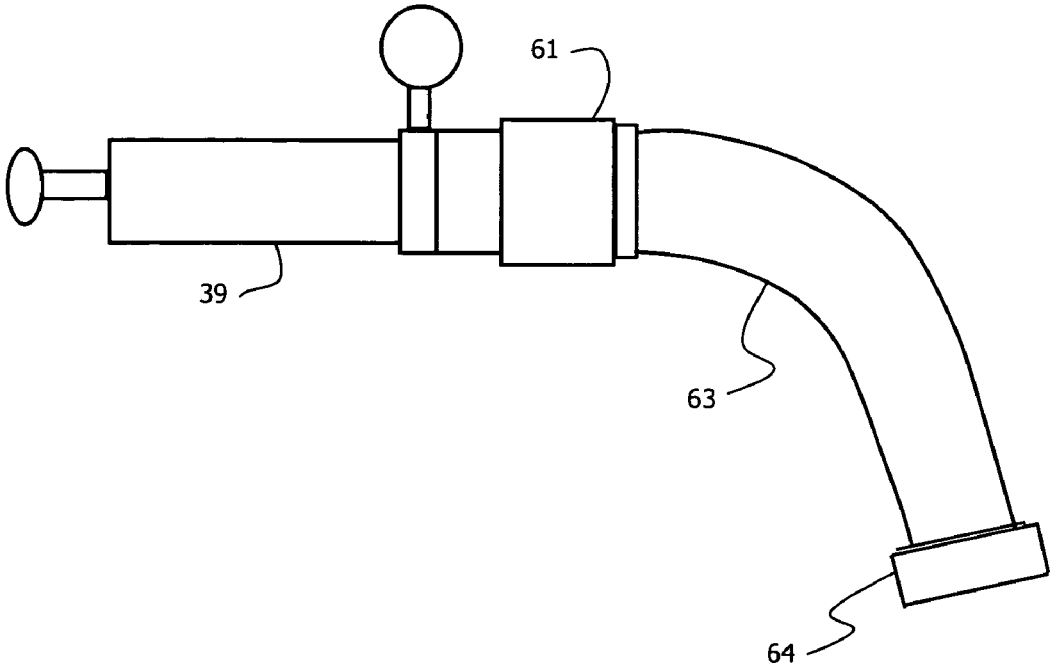
FIG. 7 is a pictorial representation of a fuel dispensing hose being tested according to one embodiment of the present invention.

FIG. 7 illustrates the apparatus in use during the testing of a nozzle. The test pump 39 has been fastened to the nozzle 44 at its coupler 45. Using a similar approach, many components can be tested individually to determine if they are a source of leakage in a more complete system that has not held pressure properly.

FIG. 7 illustrates the apparatus in use during the testing of a fuel dispensing hose. The test pump 39 has been fastened to the fuel dispensing hose 63. The fuel dispensing hose 63 has been plugged with a female threaded plug 64 at its far end.

Figure 8:
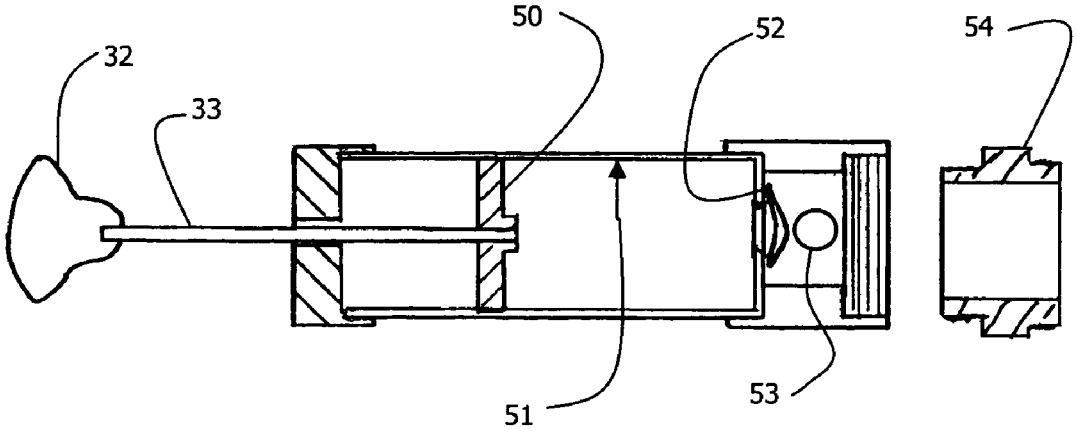
FIG. 8 is a cross-sectional view of a fuel hose pressure testing pump according to one embodiment of the present invention.

In some embodiments of the present invention, as seen in partial cross-section in FIG. 8, a coupling 54 is adapted to fluidically couple the hand pump portion to fueling components capable of vapor recovery. The hand pump portion has a pump cylinder 51. A pump piston 50 is adapted to travel within the pump cylinder 51. The pump piston 50 may have adaption for creating a relatively airtight seal as the pump piston 50 travels within the pump cylinder 51 during pumping. A pump shaft 33 is attached to the pump piston 50 on a first end, and a pump handle 32 is attached to a second end of the pump shaft 33. The coupling 54, although shown in exploded view in FIG. 5, is attached and fluidically coupled to the hand pump portion 55. A check valve 52 maintains pressure in a pressurized system after pumping by preventing back flow into the pump cylinder 51 from the downstream area. A hole 53 is available for the mounting of a pressure gauge adapted to read the pressure within the apparatus downstream from the check valve. In some embodiments, the hole 53 is on the upstream side of the check valve 52.

Figure 9:
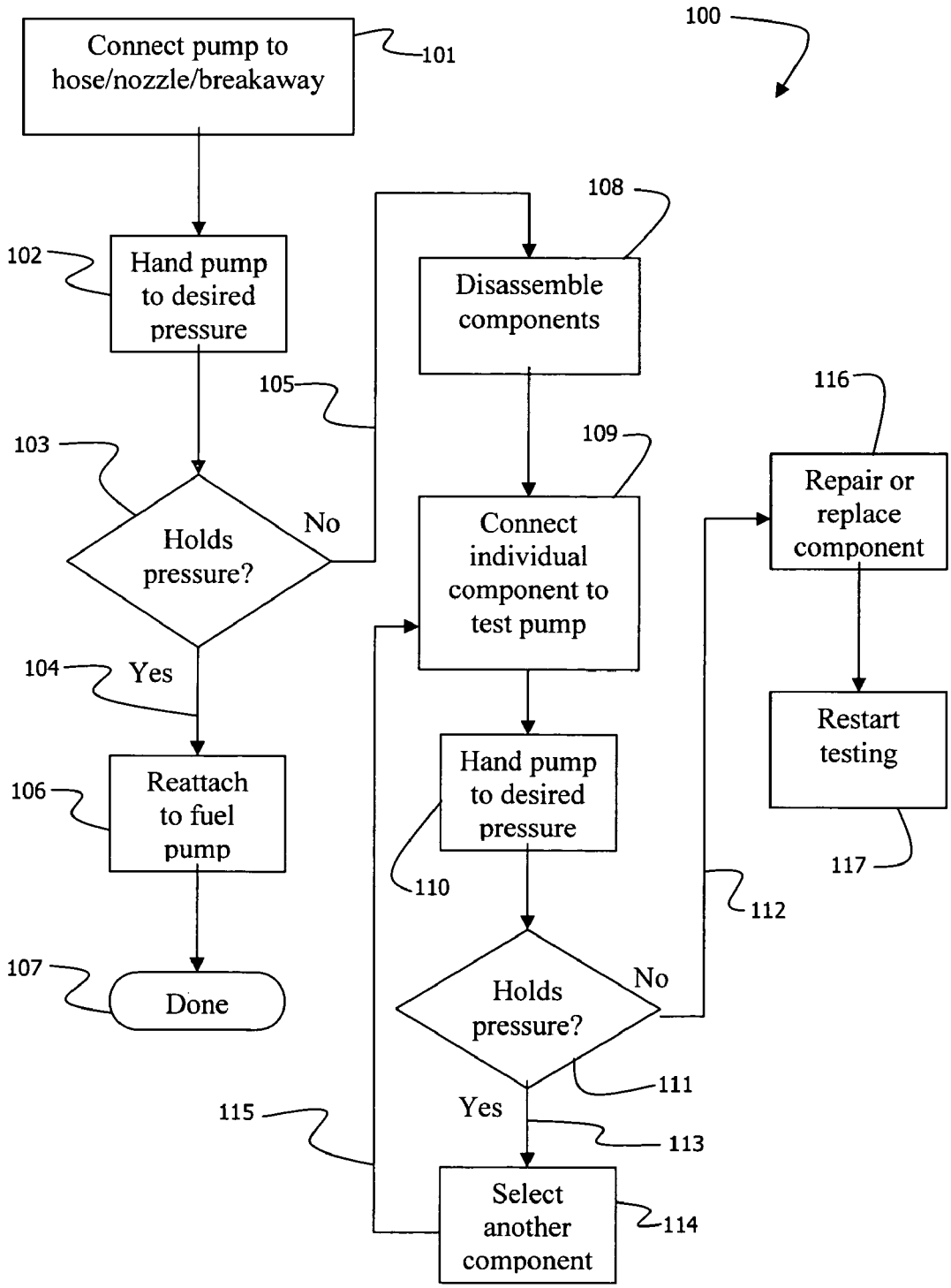
FIG. 9 is a flowchart illustrating a method of testing per some embodiments of the present invention.

A method 100 for the pressure testing of a fuel delivery recovery system is shown in FIG. 9. Typically, prior to reattaching a hoses/nozzle/breakaway combination back to a fuel pump, the hoses/nozzle/breakaway combination is attached to the pressure testing apparatus 101. The system is then hand pumped to the desired pressure 102. The system pressure is then observed to verify if the system is holding pressure 103. If the system does hold pressure per the user's requirements 104, the hose/nozzle/breakaway combination may be reattached to the fuel pump 106 and the process is complete 107.

If the system does not hold pressure 105, the user may disassemble the hose/nozzle/breakaway components 108 in order to validate individual components. An individual component may be connected to the pressure testing apparatus 109. The pump and component system is then hand pumped to the desired pressure 110. The system pressure is then observed to verify if the system is holding pressure 111. If the system does hold pressure per the user's requirements 113, another component may be selected for testing 114. The new component can then repeat the individual component testing portion 115.

This may be repeated until a failed component is found 112. The component can be repaired or replaced 116, and then the test regime can be repeated if desired 117.

As evident from the above description, a wide variety of embodiments may be configured from the description given herein and additional advantages and modifications will readily occur to those skilled in the art. The invention in its broader aspects is, therefore, not limited to the specific details, representative apparatus and illustrative examples shown and described. Accordingly, departures from such details may be made without departing from the spirit or scope of the applicant's general invention.

I claim:

1. An apparatus adapted for the pressure testing of a fuel delivery and vapor recovery system, said apparatus comprising:

a hand pump portion, said hand pump portion comprising a check valve;

a coupling, said coupling fluidically coupled to the downstream end of said check valve, said coupling adapted to directly couple said hand pump portion to vapor recovery capable fueling components, said coupling rigidly coupled to said hand pump portion; and a pressure gauge, said pressure gauge mounted to said hand pump portion, said pressure gauge adapted to measure the pressure within said apparatus downstream of said check valve.

2. The apparatus of claim 1 wherein said hand pump portion further comprises:

a pump cylinder;

a pump piston, said pump piston adapted to travel within said pump cylinder;

a pump shaft attached on a first end to said pump piston, said pump shaft adapted move said pump piston axially within said pump cylinder; and a pump handle, said pump handle attached on a second end to said pump shaft.

3. The apparatus of claim 2 further comprising a pressure relief valve, said pressure relief valve attached to said hand pump portion, said relief valve adapted to relieve pressure from within a volume downstream from said check valve.

4. The apparatus of claim 2 further comprising a pressure relief valve, said pressure relief valve attached to said hand pump portion, said relief valve adapted to relieve pressure from within a volume upstream from said check valve.

5. A method for the testing of a fuel delivery and vapor recovery system, said method comprising:

removing a short dispensing hose, fuel hose breakaway, fuel hose, and nozzle combination from a gasoline dispenser at the dispenser-short dispensing hose interface;

attaching a manual pressure testing apparatus to the short dispensing hose, fuel hose breakaway, fuel hose, and nozzle combination at the dispenser-short dispensing hose interface; and hand pumping said testing apparatus to create a pressure in said short dispensing hose, fuel hose breakaway, fuel hose, and nozzle combination.

6. The method of claim 5 further comprising:

measuring said pressure; and monitoring said pressure for a defined length of time.

7. A method for the testing of a fuel delivery and vapor recovery system, said method comprising:

removing a short dispensing hose, fuel hose breakaway, fuel hose, and nozzle combination from a gasoline dispenser at the dispenser-short dispensing hose interface;

attaching a manual pressure testing apparatus to the short dispensing hose, fuel hose breakaway, fuel hose, and nozzle combination at the dispenser-short dispensing hose interface;

hand pumping said testing apparatus to create a first pressure in said short dispensing hose, fuel hose breakaway, fuel hose, and nozzle combination;

measuring said first pressure;

monitoring said first pressure for a defined length of time;

disconnecting said fuel hose breakaway from the short dispensing hose, fuel hose breakaway, fuel hose, and nozzle combination;

attaching a manual pressure testing apparatus to a first end of said fuel hose breakaway;

attaching a plug to the second end of said fuel hose breakaway;

hand pumping said testing apparatus to create a second pressure in said fuel hose breakaway; and measuring said second pressure.

8. The method of claim 6 further comprising:

disconnecting said nozzle from the short dispensing hose, fuel hose breakaway, fuel hose, and nozzle combination;

attaching a manual pressure testing apparatus to a first end of said nozzle;

hand pumping said testing apparatus to create a pressure in said nozzle; and measuring said pressure.

9. The method of claim 6 further comprising:

disconnecting said short dispensing hose from the short dispensing hose, fuel hose breakaway, fuel hose, and nozzle combination;

attaching a manual pressure testing apparatus to a first end of said short dispensing hose;

attaching a plug to the second end of said short dispensing hose;

hand pumping said testing apparatus to create a pressure in said short dispensing hose; and measuring said pressure.

10. The method of claim 6 further comprising:

disconnecting said fuel hose from the short dispensing hose, fuel hose breakaway, fuel hose, and nozzle combination;

attaching a manual pressure testing apparatus to a first end of said fuel hose;

attaching a plug to the second end of said fuel hose;

hand pumping said testing apparatus to create a pressure in said fuel hose; and measuring said pressure.

11. An apparatus adapted for the pressure testing of a fuel delivery and vapor recovery system, said apparatus comprising:

a hand pump portion;

a coupling, said coupling fluidically coupled to said hand pump portion, said coupling rigidly coupled to said hand pump portion; said coupling comprising:

a first end, said first end rigidly coupled to said hand pump portion; and a second end, said second end adapted to couple to a vapor recovery capable fuel hose; and a pressure gauge, said pressure gauge mounted to said hand pump portion.

12. The apparatus of claim 11 wherein said hand pump portion comprises a pump axis, and wherein said coupling further comprises a central axis, wherein said pump axis ans said central axis are substantially coaxial.

* * * * *